US006113048A

United States Patent [19]

Shire

[11] Patent Number: 6,113,048

[45] Date of Patent: Sep. 5, 2000

[54] CANDLE CRADLE

[75] Inventor: Harry L. Shire, Ashland, Ohio

[73] Assignee: Dwight A. Marshall, Worthington, Ohio

[21] Appl. No.: 09/288,151

[22] Filed: Apr. 8, 1999

[51] Int. Cl.[7] ..... A47F 5/00; A47F 7/00; A47K 1/08

[52] U.S. Cl. ..... 248/309.1; 248/311.2; 248/314; D26/16

[58] Field of Search ..... 248/309.1, 311.2, 248/314, 538, 346.03; 206/77.1; 220/574, 571; D26/16

[56] References Cited

U.S. PATENT DOCUMENTS

| | | | |
|---|---|---|---|
| D. 313,479 | 1/1991 | Goldberg | D26/16 |
| D. 328,156 | 7/1992 | Bonander, Jr. | D26/21 |
| D. 369,221 | 4/1996 | Linderman | D26/9 |
| D. 416,098 | 12/1998 | Sher | D26/9 |
| 2,475,274 | 7/1949 | Beckwith | 67/23 |
| 3,964,709 | 6/1976 | LaBelle et al. | 248/133 |
| 5,044,577 | 9/1991 | Spearman | 224/42 |
| 5,139,222 | 8/1992 | Koorey et al. | 248/311.2 |
| 5,320,406 | 6/1994 | North | 248/118 |
| 5,608,929 | 3/1997 | Von Seidel | 206/77.1 |
| 5,624,043 | 4/1997 | Baptista | 248/105 |

FOREIGN PATENT DOCUMENTS

| | | | |
|---|---|---|---|
| 22125 | 10/1961 | Germany | 341/341 |

*Primary Examiner*—Ramon O Ramirez
*Assistant Examiner*—Jerome A. DeLuca
*Attorney, Agent, or Firm*—Dwight A. Marshall

[57] ABSTRACT

Apparatus for cradling a candle formed with a base member having a bottom surface for mounting the apparatus on a structure and an upper surface positioned and inclined at an angle with respect to the bottom surface for receiving a base of the candle. A supporting member is mounted on the base member adjacent the lower portion of the upper surface with respect to the bottom surface of the base member and has an outer surface thereof perpendicular to the base member bottom surface and an inner surface positioned perpendicular to the upper surface and configured for receiving and supporting the candle on the base member upper surface with a center axis of the candle positioned at the angle with respect to a vertical line perpendicular to the base member bottom surface.

22 Claims, 4 Drawing Sheets

CANDLE CRADLE

FIELD OF THE INVENTION

The invention relates to apparatus for holding a candle and in particular to apparatus for cradling the candle.

BACKGROUND AND PROBLEM

Candles have been used for centuries for lighting and for decorative purposes. Although the use of candles for lighting interior structures has decreased since the invention of the incandescent lamp the use of candles for decorative purposes have been increasing particularly in the last few years. Many commercial establishments currently have sections displaying and offering various types and structures of candles for sale. Even stores devoted to the exclusive display and selling of candles are now in the market place.

Normally, candles are placed in candle holders such that the candles are held at the base and positioned in an upright position. Typically, a candle holder such as a candelabra may have several candle holders each holding a candle in an upright position. Each candle holder generally has a cylindrical candle socket having a cavity sized for receiving the base of a candle and which socket is located on a saucer like member. The saucer is generally configured with such a circumference that the saucer may catch any burning or hot material that may drop from the burning candle and thereby help to prevent a fire.

A candle socket may be of a mug like structure having a solid circular like configuration surrounding a cavity formed for receiving the base of a long slender candle such that the candle extends upward well beyond the upper edge of the candle socket. Another candle socket has a number of spring like arcuate members formed in a circular configuration each extending upward from a base section with a center section bowed inwardly such that the arcuate member bowed sections form a circular section to grasp and hold the base of the candle in a vertical position within the socket. A single member candle holder has a circular base configuration with the upper sides of the base extending vertically upward and fluted outward from the base forming a hexagram. With this type of candle holder the base of a candle is positioned within the circular base such that the candle is held vertical with respect to the base. Another type of candle holder is a candle lamp structure having a stem mounting an ornamental globe configuration designed to hold a candle therein with the axis of the candle positioned vertical with respect to the stem. In still another type of candle holder, a candle socket is mounted within a saucer in such a position that the upper semi-circular rims of the candle socket and saucer are positioned at an angle with respect to the bottom surface of the saucer. Even though the rims are not horizontal, the candle socket apparently holds a candle with the candle axis positioned vertically.

In each of above set forth candle holders the axis of the held candle is positioned vertically thereby enabling melted material of a burning candle to flow down along sides of the candle. Several different types of candle holders have been designed to enable a candle to be positioned vertically even though the surface holding the candle holder is positioned at an angle with respect to the horizontal. One of this type of candle holder has a cylindrical candle socket mounted on a saucer having a clip securing the saucer and candle socket to a support having a curved head piece and two resilient leg pieces branching out from the base of the head piece. The clip securing the saucer and socket to the curved head piece enables the saucer and socket to slide along the surface of curved head piece. Ends of the leg pieces may be positioned on a non-horizontal surface and the clip moved along the curved head piece to locate the candle axis vertically to the horizontal. Apparatus of yet another candle holder is formed in a clip like configuration with a candle socket mounted on a surface of one of the clip members. The clip structure can apparently affix the candle socket to a non-horizontal surface with a candle held by the socket positioned vertically with respect to the horizontal.

A vertical pillar candle burns with the candle wick wavering such as to create a ragged edge around the top edge of the candle as the candle melts under the effect of the hot wick flame. Tilting the candle from the vertical position causes the candle wick to burn in a more even manner thereby creating a more even top edge that is more desirable especially for decorative candles. A problem arises with the aforementioned candle holders in that the candles are held in a vertical position and if the holders allow a burning candle to tilt there may be a possible fire if the burning candle flame or the hot melting candle material comes in contact with an adjacent flammable material.

Solution

The foregoing problem is solved by apparatus for cradling a candle wherein the cradling apparatus has a base member with a bottom surface for mounting the apparatus on a horizontal surface structure and with an upper surface positioned at a predetermined angle with respect to the bottom surface for receiving a base of the candle. A supporting member is located on the base member adjacent the lower portion of the upper surface with respect to the bottom surface of the base member with an outer surface thereof perpendicular to the base member bottom surface. An inner surface of the supporting member is positioned perpendicular to the angled upper surface of the base and is configured for receiving and cradling the candle on the base upper surface with a center axis of the candle positioned at the predetermined angle with respect to a vertical line perpendicular to the base member bottom surface.

In accordance with one embodiment of the invention, apparatus formed of a fire retardant material for cradling a candle has a circular base member with a round bottom surface for mounting the candle cradle apparatus on a horizontal structure and with an upper inclined circular surface positioned at a predefined angle of a range of 8° to 200° with respect to the bottom circular surface formed for receiving a base section of the candle. A semicircular supporting member is located a rear portion of the circular base member adjacent a lower portion of the upper circular surface with respect to the bottom circular surface of the base member and is formed with an outer surface thereof perpendicular to the base member bottom circular surface. The inner surface of the -supporting member is positioned perpendicular to the upper inclined circular surface of the base member and is configured for receiving and cradling a circular candle on the base upper circular surface with a center axis of the candle positioned at the predefined angle with respect to a vertical line perpendicular to the base member bottom surface.

In accordance with another embodiment of the invention, candle cradle apparatus in accordance with the principles of the invention has a square base member with a bottom square surface for mounting the apparatus on a horizontal surface and an upper square surface wherein a plane of the upper square surface is formed at an incline at a predefined angle having a range of 8° to 20° with respect to a plane of the bottom square surface. A candle supporting member is located on the base member upper square surface adjacent a portion of the upper square positioned closest to a corresponding portion of the bottom square surface of the base member. The outer surface of the candle supporting member is formed with an outer surface thereof perpendicular to the base member bottom square surface and with an inner surface positioned perpendicular to the upper square surface. Sides of the candle supporting member extend along edges of the base member for receiving and cradling a square candle on the base member upper square surface with a center axis of the cradled candle positioned at the predefined angle with respect to a vertical line perpendicular to the base member bottom square surface.

In accordance with still another embodiment of the invention, candle cradle apparatus in accordance with the principles of the invention has a polygon configured base member formed with a bottom polygon surface for mounting the apparatus on a horizontal surface and with an upper polygon surface wherein a plane of the upper polygon surface is formed at an incline of a predefined angle having a range of 8° to 20° with respect to a plane of the bottom polygon surface. A candle supporting member is located on the base member upper polygon surface adjacent a portion of the upper polygon surface positioned closest to a corresponding portion of the bottom polygon surface of the base member. An outer surface of the candle supporting member is positioned perpendicular to the base member bottom polygon surface and an inner surface is positioned perpendicular to the upper polygon surface. Sides of the support member extend along edges of the base member upper polygon surface for receiving and cradling a polygon candle on the base upper polygon surface with a center axis of the cradled candle positioned at the predefined angle with respect to a vertical line perpendicular to the base member bottom polygon surface.

In one configuration of the polygon candle cradle apparatus, the base member is formed as a polygon having bottom and upper triangular surfaces. A plane of the upper triangular surface is formed at a predefined angle having a range of 8° to 20° with respect to a plane of the bottom triangular surface. An apex of the upper triangular surface of the base member is positioned closer to a corresponding apex of the bottom triangular surface and the base member is formed such that a plane of the upper triangular surface extends upward from a plane of the bottom triangular surface at the predetermined angle. A candle cradling supporting member is formed as a pair of legs each extending from outward from the apex of the base member lower and upper triangular surfaces and abut edges of the base upper triangular surface toward a widest section of the triangular base member. The outer surface of the angled supporting member is formed perpendicular to the base bottom triangular surface and the inner surface perpendicular to the base inclined upper triangular surface for receiving and cradling a triangular candle.

In yet another configuration of the candle cradle apparatus, the base member is formed as an elliptical configured base member having a bottom elliptical surface for mounting the apparatus on a horizontal surface and an upper elliptical surface for holding the bottom of an elliptical candle. A plane of the upper elliptical surface is formed at an incline of a predefined angle having a range of 8° to 20° with respect to a plane of the bottom elliptical surface. A semi-elliptical candle supporting member is located on the base member upper elliptical surface adjacent a portion of the upper elliptical surface positioned closest to a corresponding portion of the bottom elliptical surface of the base member. The outer surface of the semi-elliptical supporting member is formed perpendicular to the base member bottom elliptical surface and the supporting member inner surface is positioned perpendicular to the inclined upper elliptical surface. The supporting member has edges configured to extend along edges of the base member upper elliptical surface for receiving and cradling an elliptical candle on the base member upper elliptical surface with a center axis of the cradled candle positioned at the predefined angle with respect to a vertical line perpendicular to the base member bottom elliptical surface.

DRAWING DESCRIPTION

FIG. 1 is a view of a circular candle cradle for holding and cradling a circular configured pillar candle in accordance with the principles of the invention, FIG. 2 illustrates a frontal view of the circular candle cradle set forth in FIG. 1, FIG. 3 illustrates a side view of the circular candle cradle set forth in FIGS. 1 and 2, FIG. 4 illustrates a sectional view of the circular candle cradle set forth in FIGS. 1, 2, and 3, FIG. 5 is an oblique view of a candle cradle for cradling a square pillar candle in accordance with the principles of the invention, FIG. 6 is an oblique view of another embodiment of the candle cradle set forth in FIG. 5 for cradling a square pillar candle, FIG. 7 is an oblique view of a candle cradle for cradling a polygon configured pillar candle in accordance with the principles of the invention, FIG. 8 is an oblique view of another embodiment of the candle cradle set forth in FIG. 7 for cradling a polygon configured pillar candle, FIG. 9 is an oblique view of a candle cradle for cradling an elliptical configured pillar candle in accordance with the principles of the invention, FIG. 10 is an oblique view of another embodiment of the candle cradle set forth in FIG. 9 for cradling an elliptical configured pillar candle, and FIG. 11 is an oblique view of a candle cradle for cradling a triangular configured pillar candle in accordance with the principles of the invention.

DETAILED DESCRIPTION

Figure 1:
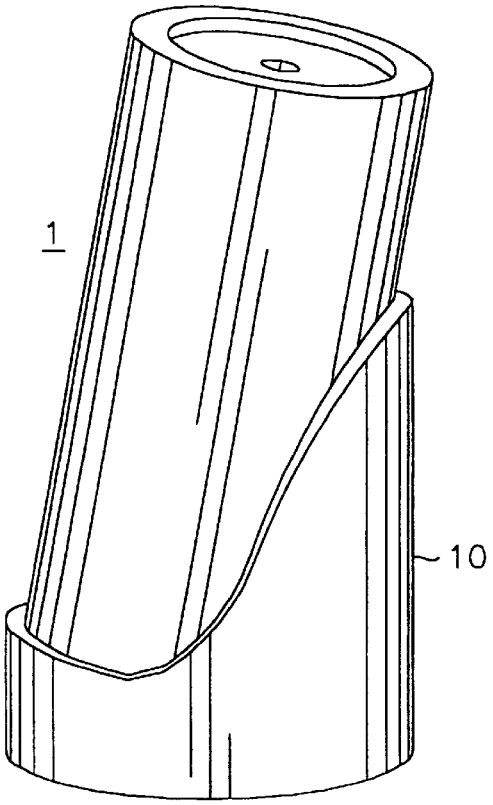

In an exemplary embodiment of the invention, candle cradle 10, FIG. 1 of the drawing, is formed for holding and cradling a circular or round configured candle 1 such that the vertical centerline axis of candle 1 is positioned at a predefined angle with respect to a vertical line of a horizontal mounting surface. Tilting candle 1 from the vertical position causes the candle wick to burn in a more even manner thereby creating a more even top edge that is desirable especially for decorative candles. Candle cradle 10 is configured to hold candle 1 in a tilted position such that neither the burning candle flame nor the hot melting material of the candle comes in contact with an adjacent flammable material when candle holder 10 is positioned on a horizontal surface away from nearby inflammable material.

Figure 2:
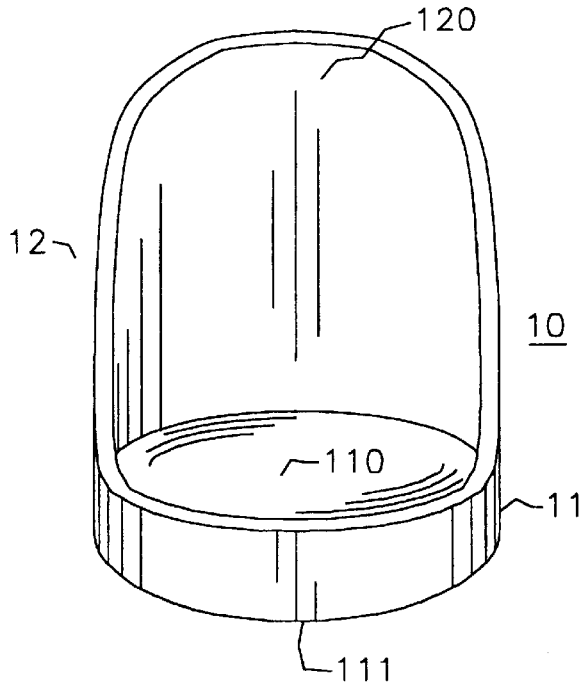

Referring to FIG. 2, candle cradle 10 may be a unitary member having a base 11 for receiving and supporting the base of a candle and a supporting member 12 for receiving and cradling a candle having one end supported by the base 11. Candle cradle 10 may also, in accordance with the invention, be constructed of multiple parts such as a base member 11 and a supporting member 12 which may be assembled to base member 11 in any of a number of well known ways. Typically, candle cradle 10 may be constructed of a fire retardant material such as any one of a number of ceramic or glass and the like compounds. In an exemplary embodiment of the invention, candle cradle 10 has a base member 11 having a bottom surface 111 for mounting the apparatus on a surface such as a horizontal surface. Base member 11 also has an upper surface 110 a plane of which is positioned at a predefined angle and inclined with respect to a plane of the bottom surface 111 and which may be formed in a circular configuration for receiving a base section of a circular pillar candle 1.

Figure 3:
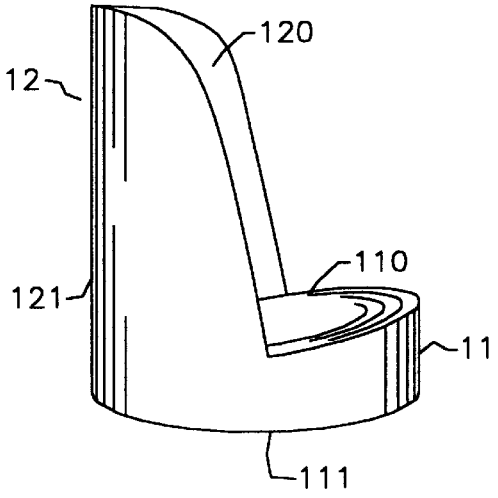
Figure 4:
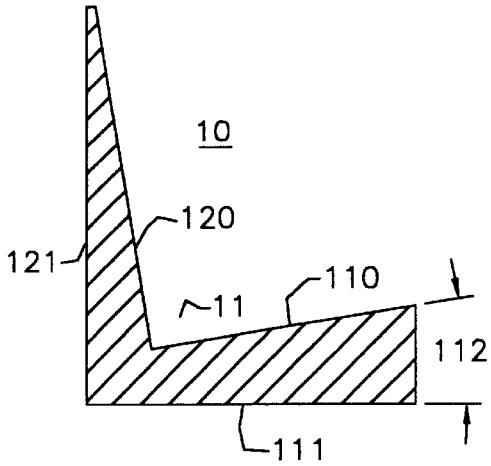

A supporting section or member 12 is located on base member 11 adjacent the lower portion of the upper surface 110 with respect to the bottom surface 111 of base member 11. The outer surface 121, FIG. 3, thereof is perpendicular to the base member bottom surface 111. An inner surface 120 of supporting member 12, FIG. 4, is positioned perpendicular to the inclined upper surface 110 of base member 11 and is configured for receiving and cradling a candle on the inclined upper surface 110 of base member 11 with a center axis of the candle positioned at a predefined angle with respect to a vertical line perpendicular to the base member bottom surface 111. The base member upper surface 110 is inclined at the predefined angle 112 with respect to the base member lower surface 111 wherein the predefined angle 112 may, although not limited thereto, have a typical range of 8° to 20°. Base member 11 is formed as a circular member having bottom and upper circular surfaces 111, 110 wherein the upper circular surface 110 is spaced apart from the bottom circular surface 111 by the predefined angle 112. A candle, having its base positioned on the inclined upper circular surface 110, will have the centerline axis of the candle offset from a line perpendicular to the base member bottom surface 111 by the predefined angle. The candle cradle 10 supporting member 12, FIG. 2, is formed as a semicircular member forth, is formed with semi-circular outer surface 121, FIG. 3, thereof perpendicular to the base member lower circular surface 111. The inner semi-circular surface 120, FIG. 4, is perpendicular to the base member upper surface 110 for receiving and cradling the candle. Semi-circular supporting member 12 may be flared at the outer edges so as to catch any molten material generated by a burning candle cradled by candle cradle 10. Also in accordance with the invention, the upper outer edge of supporting member 12 may be formed smaller to more closely relate to the upper outer surface of a candle and flared to a wider bottom outer edge to receive the base portion of a candle.

Figure 5:
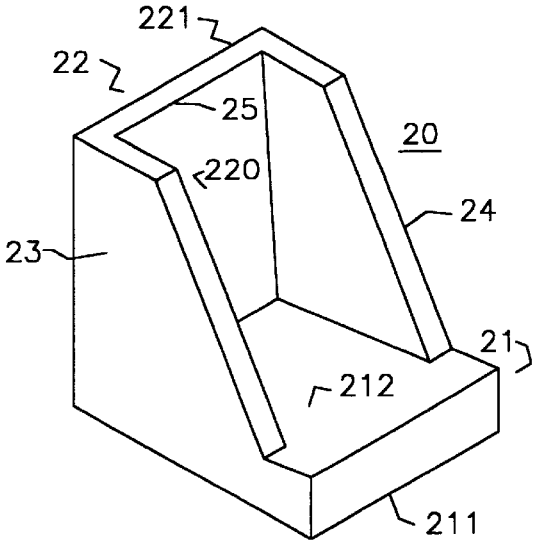

In another embodiment of the invention, FIG. 5, a candle cradle 20 may be formed of a fire retardant material and have a square base member 21 having a bottom square surface 211 for mounting the apparatus on a horizontal surface and an upper square surface 212 wherein a plane of the upper square surface is formed of an incline at a predefined angle having a range of 8° to 20° with respect to a plane of the bottom square surface 211. A partially square configured candle supporting member 22 is positioned on the base member upper square surface 212 adjacent a portion of the upper square surface 212 positioned closest to a corresponding portion of the bottom square surface 211 of the base member 21. The outer surface 221 thereof is formed perpendicular to the base member bottom square surface 211 and the inner surface 220 is positioned perpendicular to the inclined upper square surface 212. Sides 23, 24 of the candle support member 22 are configured to extend along edges of the base member for receiving and cradling the candle on the upper square surface 212 with a center axis of the cradled candle positioned at the predefined angle range of 8° to 20° with respect to a vertical line perpendicular to the base member inclined bottom square surface 211.

In one configuration of the above set forth square base candle cradle, FIG. 5, the base member 21 is formed as a square having bottom and upper square surfaces 211, 212, respectively, wherein a plane of the upper square surface 211 is formed at the predefined angle with respect to a plane of the bottom square surface 211 such that one edge of the upper square surface 212 is positioned closer to a corresponding edge of the bottom square surface 211. In this configuration, a line lying in the upper square surface 212 and extending perpendicular from the back edge to the front opposite edge is inclined with respect to a corresponding line lying in the bottom square surface 211 at the predefined angle range of 8° to 20°. The supporting member 22 for square candle cradle 20 is formed as a generally U-configured member with a base 25 adjacent the one edge of the base member upper square surface 212 nearest the corresponding edge of the square base member bottom surface 211. Legs 23, 24 extend outward at right angles from base 25 and abut edges of the base member upper square surface 212 adjacent the base 25 with an outer surface 221 thereof perpendicular to the square base member bottom surface 211 and with an inner surface 220 perpendicular to the inclined square base member upper surface 212 for receiving and cradling the candle.

Figure 6:
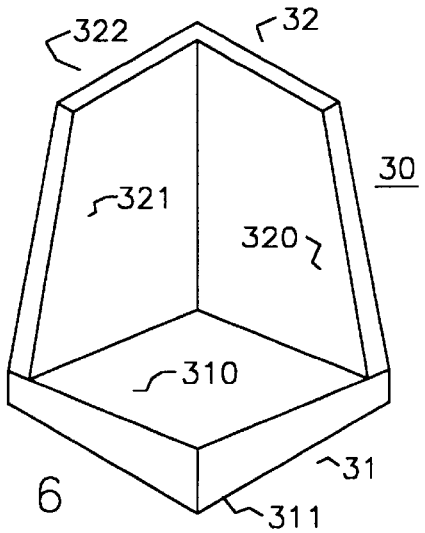

In another configuration of the above set forth square base candle cradle, Fig. 6, a square candle cradle 30 has a base member 31 formed as a square having bottom and upper square surfaces 311, 310, respectively, wherein a plane of the upper square surface 310 is formed at the predefined angle having a range of 8° to 20° with respect to a plane of the bottom square surface 311. One corner of the upper square surface 310 of base member 31 is positioned closer to a corresponding corner of the bottom square surface 311 and formed such that a diagonal lying in the upper square surface 310 and extending from the one corner to an opposite corner of the base member upper square surface 310 is inclined and extends upward at the predetermined angle from a corresponding diagonal lying in the base member lower square surface 311. The supporting member 32 is formed as a generally right angled member with a juncture of two legs 320, 321 adjacent the one corner of the base member upper square surface 310 nearest the corresponding corner of the base member bottom square surface 311. Each leg 320, 321 is formed abutting an edge of the base member upper square surface 310 adjacent the one corner and having outer surfaces 322 thereof perpendicular to the base member bottom square surface 311 and with an inner surface of each leg 320, 321 perpendicular to the base member upper square surface 310 for receiving and cradling the candle.

Figure 7:
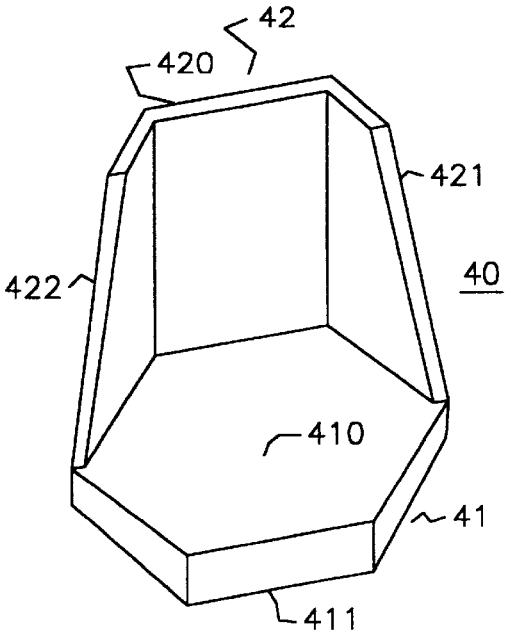

In another embodiment of the invention, FIG. 7, a candle cradle 40 may be formed of a fire retardant material and have a polygon configured base member 41 having a bottom polygon surface 411 for mounting the apparatus on a horizontal surface and an upper polygon surface 410 wherein a plane of the upper polygon surface is formed at an incline of a predefined angle having a range of 8° to 20° with respect to a plane of the bottom polygon surface 411. A candle supporting member 42 is located on the base member upper polygon surface 410 adjacent a portion of the upper polygon surface 410 positioned closest to a corresponding portion of the base member bottom polygon surface 411. The outer surface of rear portion 420 and legs 421, 422 of supporting member 42 are formed perpendicular to the base member bottom polygon surface 411 and the inner surface walls thereof are positioned perpendicular to the upper polygon surface 410. Rear portion 420 and legs 421 and 422 are configured to extend along rear edges of the base member upper polygon surface 410 for receiving and cradling a polygon pillar candle on the base upper polygon surface 410 with a center axis of the cradled candle positioned at the predefined angle with respect to a vertical line perpendicular to the base member bottom polygon surface 411.

In one configuration of the above set forth polygon candle cradle, FIG. 7, the base member 41 is formed with bottom and upper hexagon surfaces 410, 411 wherein a plane of the upper hexagon surface 410 is formed at a predetermined angle having a range of 8° to 20° with respect to a plane of the bottom hexagon surface 411 such that a rear edge of the upper hexagon surface 410 of base member 41 is positioned closer to a corresponding rear edge of the bottom hexagon surface 410 and extends upward from the bottom hexagon surface 411 at the predetermined angle. Supporting member 42 is formed as a generally multi-sided configured member having a rear portion 420 adjacent the rear edge of the base upper hexagon surface 420 and is formed as a partially configured hexagon with legs 421, 422 thereof extending outward from the rear portion 420 and abutting edges of the upper hexagon surface 410 toward the widest section of the hexagon base 41. The outer surface of rear portion 420 and legs 421, 422 are perpendicular to the base bottom hexagon surface 411 and the inner surfaces thereof are perpendicular to the base member inclined upper hexagon surface 410 for receiving and cradling a hexagon configured pillar candle.

Figure 8:
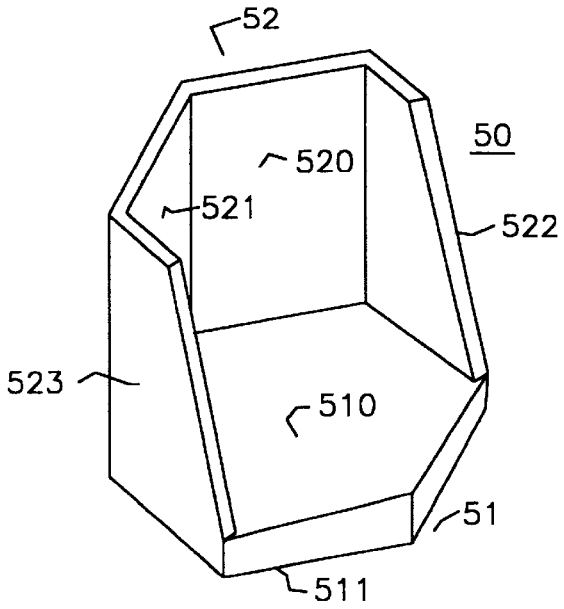

In another configuration of a polygon candle cradle 50, FIG. 8, the base member 51 is formed as a polygon having bottom and upper polygon surfaces 511, 510, respectively, wherein a plane of the upper polygon surface 510 is formed at a predefined angle having a range of 8° to 20° with respect to a plane of the bottom polygon surface 511. One corner of the base member upper polygon surface 510 is positioned closer to a corresponding corner of the bottom polygon surface 511. A line lying in the plane of the upper polygon surface 510 and extending from the one corner of the upper polygon surface 510 to an opposite corner thereof is inclined and extends upward from a corresponding line in the plane of the bottom polygon surface 511 at the predetermined angle. The supporting member 52 is formed as a generally multi-sided configured member having a rear edge adjacent and vertical to the one corner of the inclined base upper polygon surface 510 and formed as a partially configured polygon with legs 520, 521, 522, 523 thereof extending outward from the rear edge and abutting edges of the base upper polygon surface 510. Legs 520, 521, 522, 523 extend along the edges of the upper polygon surface 510 toward the widest section of the polygon base 51. The outer surfaces of legs 520, 521, 522, 523 are perpendicular to the base bottom polygon surface 511 and the inner surfaces are perpendicular to the base upper polygon surface 510 for receiving and cradling a polygon configured candle.

Figure 11:
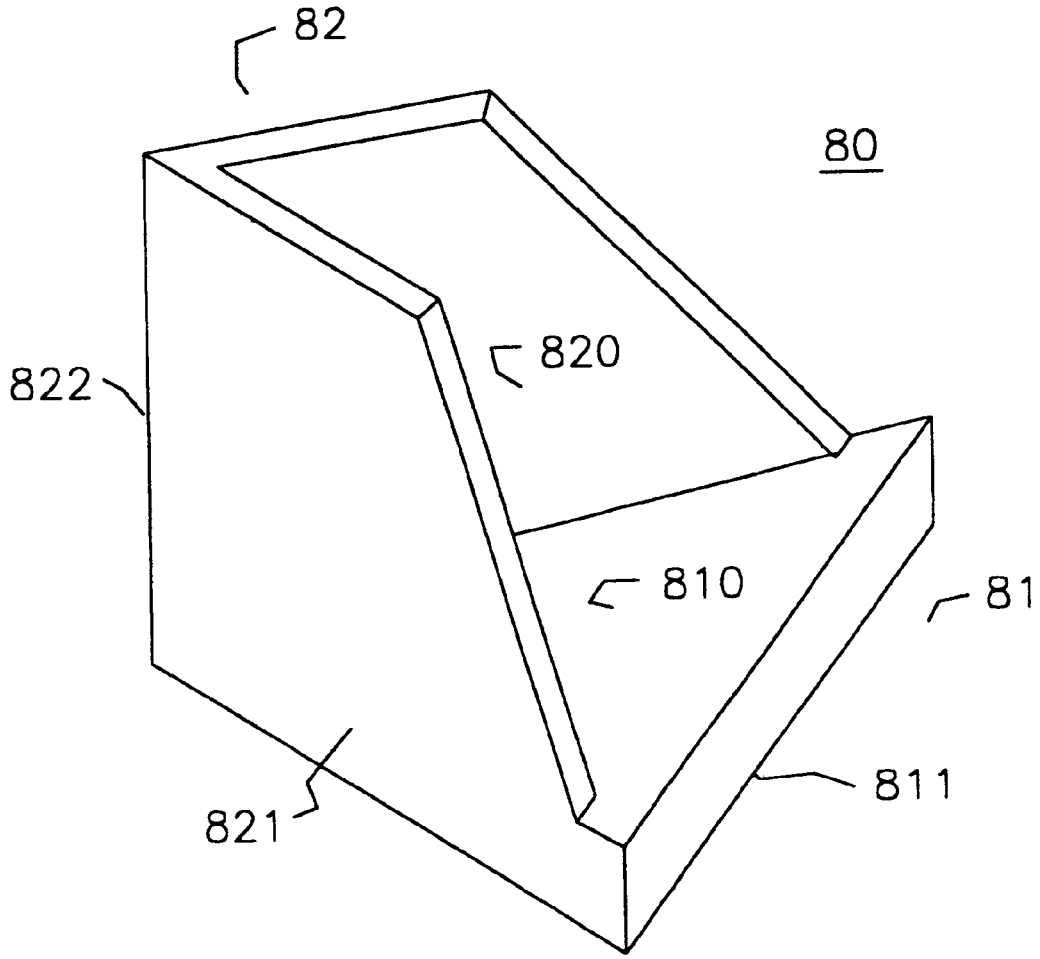

In another configuration of a polygon candle cradle 80, FIG. 11, the base member 81 is formed as a triangle having bottom and upper triangular surfaces 811, 810, respectively, wherein a plane of the upper triangular surface 810 is formed at a predefined angle having a range of 8° to 20° with respect to a plane of the bottom triangular surface 811. The apex of the upper triangular surface 810 of base member 81 is positioned closer to a corresponding apex of the bottom triangular surface 811 and formed such that a plane of the upper triangular surface 810 is inclined and extends upward from a plane of the bottom triangular surface 811. The supporting member 82 is formed as a pair of legs 820, 821 each extending from a line 822 perpendicular to and extending outward from the apex of the base triangular member 81 and abutting edges of the base upper triangular surface 810 toward the widest section of the triangular base member 81. The outer surface of legs 820, 821 are formed perpendicular to the base bottom triangular surface 811 and the leg inner surfaces are formed perpendicular to the base upper triangular surface 810 for receiving and cradling a triangular candle.

Figure 9:
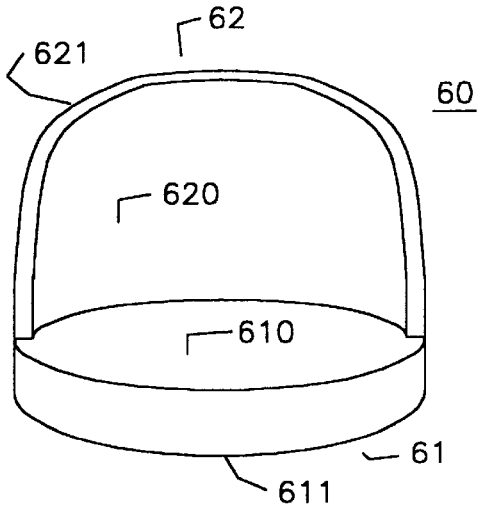

In yet another embodiment of the invention, FIG. 9, a candle cradle 60 may be formed of a fire retardant material and have an elliptical configured base member 61 having a bottom elliptical surface 611 for mounting the apparatus on a horizontal surface and an upper elliptical surface 610 wherein a plane of the upper elliptical surface 610 is formed at an incline of a predefined angle having a range of 8° to 20° with respect to a plane of the bottom elliptical surface 611. A semi-elliptical candle supporting member 62 is located on the base member upper elliptical surface 610 adjacent a portion thereof that is positioned closest to a corresponding portion of the bottom elliptical surface 611. An outer surface 621 of the candle supporting member 62 is formed perpendicular to the base member bottom elliptical surface 611 and has an inner surface 620 positioned perpendicular to the inclined upper elliptical surface 610. The supporting member 62 is configured having sides thereof extending along edges of the base member upper elliptical surface 620 and is an open at one end for receiving and cradling an elliptical candle with a center axis of the cradled candle positioned at the predefined angle with respect to a vertical line perpendicular to the base member bottom elliptical surface 611.

In one configuration of the above set forth elliptical candle cradle, FIG. 9, the base member 61 is formed with bottom and upper elliptical surfaces 611, 610 and formed with the minor axis of the upper elliptical surface 610 inclined and spaced apart from a corresponding minor axis of the bottom elliptical surface by 611 by a predefined angle having a range of 8° to 20°. Supporting member 62 is formed as a semi-elliptical member adjacent an edge of the upper elliptical surface 610 nearest a corresponding edge of the lower elliptical surface 611 and is formed with an outer surface 621 perpendicular to the lower elliptical surface 611 and with an inner surface 620 perpendicular to the upper elliptical surface 610 for receiving and cradling an elliptical candle.

Figure 10:
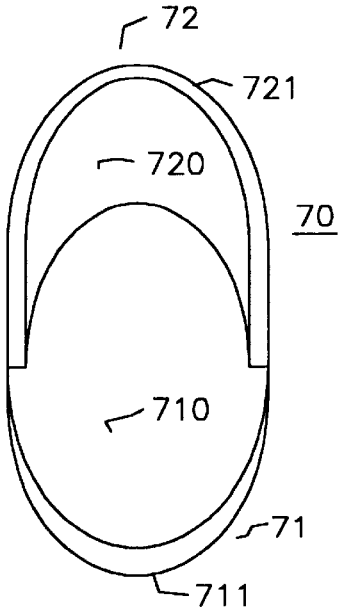

In another configuration, the base member 71 of an elliptical candle cradle 70, FIG. 10, is formed with bottom and upper elliptical surfaces 711, 710, respectively, wherein a major axis of the upper elliptical surface 710 is inclined and spaced apart from a corresponding major axis of the bottom elliptical surface 711 by the predefined angle having a range of 8° to 20°. Supporting member 72 is formed as a semi-elliptical member adjacent an edge of the base member upper elliptical surface 710 nearest the base member lower elliptical surface 711 and is formed with an outer surface 721 perpendicular to the base member lower elliptical surface 711 and an inner surface 720 perpendicular to the base member upper surface 710 for receiving and cradling an elliptical candle.

While the foregoing detailed description has described several embodiments of a candle cradle in accordance with this invention, it is to be understood that the above description is merely illustrative and does not limit the scope of the claimed invention. Particularly, the disclosed candle cradle may have many shapes and configurations for receiving and cradling a candle. For example, the polygon configured candle cradle in accordance with the instant invention may have a base configured as a triangle with a support member formed for cradling triangle and pyramid configured candles. It is obvious from the foregoing that the facility, economy and efficiency of candle holding apparatus may be substantially enhanced by candle cradling apparatus for holding and cradling a candle with the candle center axis off-set from a line perpendicular to a horizontal candle supporting structure.

What is claimed is:

1. Apparatus for cradling a candle wherein the apparatus comprises a base member having a bottom surface for mounting the apparatus on a horizontal structure and an upper surface positioned and inclined at a predefined angle with respect to the bottom surface and formed for receiving a base section of the candle on the inclined upper surface, and a supporting member located on the base member adjacent the lower portion of the upper surface with respect to the bottom surface of the base member and with an outer surface thereof perpendicular to the base member bottom surface and having an inner surface positioned perpendicular to the upper surface and configured for receiving and cradling the candle mounted on the base upper surface with a center axis of the candle positioned at the predefined angle with respect to a vertical line perpendicular to the base member bottom surface.

2. The candle cradling apparatus set forth in claim 1 wherein the base member predefined angle between the base member upper and lower surfaces has a range of 8° to 20°.

3. The candle cradling apparatus set forth in claim 1 wherein the base member is formed as a circular member having bottom and upper circular surfaces wherein a plane of the upper circular surface is spaced apart from a plane of the bottom circular surface by the predefined angle.

4. The candle cradling apparatus set forth in claim 3 wherein the supporting member is formed as a semicircular member adjacent an edge of the base member upper surface nearest the base member lower surface and formed with an outer surface thereof perpendicular to the base member lower surface and with an inner surface perpendicular to the base member upper surface for receiving and cradling a candle having a circular cross section.

5. The candle cradling apparatus set forth in claim 1 wherein the base member is formed as a square member having bottom and upper square surfaces wherein a plane of the upper surface is formed at the predefined angle with respect to a plane of the bottom surface such that one edge of the upper surface is positioned closer to a corresponding edge of the bottom surface.

6. The candle cradling apparatus set forth in claim 5 wherein the supporting member is formed as a generally U-configured member with a base adjacent the one edge of the base member upper surface nearest the corresponding edge of the base member bottom surface and formed with legs abutting edges of the base member upper surface adjacent the one edge of the base member upper surface with an outer surface thereof perpendicular to the base member bottom surface and with an inner surface perpendicular to the base member upper surface for receiving and cradling a candle having a square cross section.

7. The candle cradling apparatus set forth in claim 1 wherein the base member is formed as a square member having bottom and upper square surfaces wherein a plane of the upper surface is formed at the predefined angle with respect to a plane of the bottom surface such that one corner of the upper surface is positioned closer to a corresponding corner of the bottom surface and formed such that a diagonal extending from the one corner to an opposite corner of the base member upper surface extends and is inclined upward at the predetermined angle from a corresponding diagonal of the lower surface.

8. The candle cradling apparatus set forth in claim 7 wherein the supporting member is formed as a generally right angled member with a juncture of two legs adjacent the one corner of the base member upper surface nearest the corresponding corner of the base member bottom surface and formed with each leg abutting an edge of the base member upper surface adjacent the one corner and having an outer surface thereof perpendicular to the base member bottom surface and with an inner surface perpendicular to the base member upper surface for receiving and cradling a candle having a square cross section.

9. The candle cradling apparatus set forth in claim 1 wherein the base member is formed as a polygon having bottom and upper polygon surfaces wherein a plane of the upper surface is formed at the predefined angle with respect to a plane of the bottom surface such that one edge of the upper surface is positioned closer to a corresponding edge of the bottom surface and formed such that the upper surface extends and is inclined upward from the bottom surface at the predetermined angle.

10. The candle cradling apparatus set forth in claim 9 wherein the supporting member is formed as a generally multi-sided configured member having a rear portion adjacent the one edge of the base upper surface and formed as a partially configured polygon with legs thereof extending outward from the rear portion and abutting edges of the polygon base member toward the widest section thereof and having an outer surface perpendicular to the base member bottom surface and with an inner surface perpendicular to the base member upper surface for receiving and cradling a candle having a polygon configured cross section.

11. The candle cradling apparatus set forth in claim 1 wherein the base member is formed as a polygon having bottom and upper polygon surfaces wherein a plane of the upper surface is formed at the predefined angle with respect to a plane of the bottom surface such that one corner of the upper surface is positioned closer to a corresponding corner of the bottom surface and formed such that a line extending from the one corner of the upper surface to an opposite corner thereof extends and is inclined upward from a corresponding line of the bottom surface at the predetermined angle.

12. The candle cradling apparatus set forth in claim 11 wherein the supporting member is formed as a generally multi-sided configured member having a rear edge adjacent the one corner of the base member upper surface and is formed as a partially configured polygon with legs thereof extending outward from the rear edge and abutting edges of the base member upper surface toward the widest section of the base member and having an outer surface thereof perpendicular to the base member bottom surface and with an inner surface perpendicular to the base member upper surface for receiving and cradling a candle having a polygon cross section.

13. The candle cradling apparatus set forth in claim 1 wherein the base member is formed as a polygon having bottom and upper triangular surfaces wherein a plane of the upper surface is formed at the predefined angle with respect to a plane of the bottom surface such that an apex of the upper surface is positioned closer to a corresponding apex of the bottom surface and is formed such that a plane of the upper surface extends and is inclined upward from a plane of the bottom surface at the predetermined angle.

14. The candle cradling apparatus set forth in claim 13 wherein the supporting member is formed as a pair of legs each extending from outward from the apex of the base member upper surface closest the apex of the base member lower surface and abutting edges of the base member upper surface toward a widest section of the triangular base member and having an outer surface thereof perpendicular to the base member bottom surface and with an inner surface perpendicular to the base member upper surface for receiving and cradling a candle having a triangular cross section.

15. The candle cradling apparatus set forth in claim 1 wherein the base member is formed as an elliptical member having bottom and upper elliptical surfaces and wherein a minor axis of the upper surface is spaced apart and inclined from a corresponding minor axis of the bottom surface by the predefined angle.

16. The candle cradling apparatus set forth in claim 15 wherein the supporting member is formed as a semi-elliptical member adjacent an edge of the base member upper surface nearest a corresponding edge of the base member lower surface and is formed with an outer surface thereof perpendicular to the base member lower surface and with an inner surface perpendicular to the base member upper surface for receiving and cradling a candle having an elliptical cross section.

17. The candle cradling apparatus set forth in claim 1 wherein the base member is formed as an elliptical member having bottom and upper elliptical surfaces and wherein a major axis of the upper surface is spaced apart from a corresponding major axis of the bottom surface by the predefined angle.

18. The candle cradling apparatus set forth in claim 17 wherein the supporting member is formed as a semi-elliptical member adjacent an edge of the base member upper surface nearest a corresponding edge of the base member lower surface and is formed with an outer surface thereof perpendicular to the base member lower surface and with an inner surface perpendicular to the base member upper surface for receiving and cradling a candle with an elliptical cross section.

19. Apparatus formed of a fire retardant material for cradling a pillar candle of a circular cross section wherein the apparatus comprises a circular base member having a bottom circular surface for mounting the apparatus on a horizontal structure and an upper circular surface positioned at a predefined angle having a range of 8° to 20° with respect to the bottom circular surface and formed for receiving a base section of the candle, and a semicircular supporting member located on the base member adjacent the lower portion of the upper surface with respect to the bottom surface and with an outer surface thereof perpendicular to the base member bottom surface and having an inner surface positioned perpendicular to the upper surface and configured for receiving and cradling the candle received on the base upper surface with a center axis of the candle positioned at the predefined angle with respect to a vertical line perpendicular to the base member bottom surface.

20. Apparatus formed of a fire retardant material for cradling a pillar candle having a square cross section wherein the apparatus comprises a square base member having a bottom square surface for mounting the apparatus on a horizontal surface and an upper square surface wherein a plane of the upper surface is formed at an incline at a predefined angle having a range of 8° to 20° with respect to a plane of the bottom surface, and a candle supporting member located on the base member upper surface adjacent a portion of the upper surface positioned closest to a corresponding portion of the bottom surface and with an outer surface thereof perpendicular to the base member bottom surface and having an inner surface positioned perpendicular to the upper surface and configured having sides thereof extending along edges of the base member upper surface for receiving and cradling the candle on the base member upper surface with a center axis of the cradled candle positioned at the predefined angle with respect to a vertical line perpendicular to the base member bottom surface.

21. Apparatus formed of a fire retardant material for cradling a pillar candle having a polygon cross section wherein the apparatus comprises a polygon configured base member having a bottom polygon surface for mounting the apparatus on a horizontal surface and an upper polygon surface wherein a plane of the upper surface is formed at an incline of a predefined angle having a range of 8° to 20° with respect to a plane of the bottom surface, and a candle supporting member located on the base member upper surface adjacent a portion of the upper surface positioned closest to a corresponding portion of the bottom surface and with an outer surface thereof perpendicular to the base member bottom polygon surface and having an inner surface positioned perpendicular to the upper surface and configured having sides thereof extending along edges of the base member upper surface for receiving and cradling the candle on the base member upper surface with a center axis of the cradled candle positioned at the predefined angle with respect to a vertical line perpendicular to the base member bottom surface.

22. Apparatus formed of a fire retardant material for cradling a pillar candle having an elliptical cross section wherein the apparatus comprises an elliptical configured base member having a bottom elliptical surface for mounting the apparatus on a horizontal surface and an upper elliptical surface wherein a plane of the upper surface is formed at an incline of a predefined angle having a range of 8° to 20° with respect to a plane of the bottom surface, and a semi-elliptical candle supporting member located on the base member upper surface adjacent a portion of the upper surface positioned closest to a corresponding portion of the bottom surface and with an outer surface thereof perpendicular to the base member bottom surface and having an inner surface positioned perpendicular to the inclined upper surface and configured having sides thereof extending along edges of the base member upper surface and open at one end for receiving and cradling the candle on the base member upper surface with a center axis of the cradled candle positioned at the predefined angle with respect to a vertical line perpendicular to the base member bottom surface.

* * * * *